US005113802A

United States Patent [19]

Le Blanc

[11] Patent Number: 5,113,802

[45] Date of Patent: May 19, 1992

[54] METHOD AND APPARATUS FOR REMOVING DEPOSIT FROM RECOVERY BOILERS

[75] Inventor: Joseph V. Le Blanc, Savannah, Ga.

[73] Assignee: Union Camp Corporation, Wayne, N.J.

[21] Appl. No.: 675,222

[22] Filed: Mar. 26, 1991

[51] Int. Cl.[5] ..... F22B 37/18; F22B 37/48

[52] U.S. Cl. ..... 122/379; 122/392; 134/1; 165/95

[58] Field of Search ..... 122/379, 392; 134/1; 165/95

[56] References Cited

U.S. PATENT DOCUMENTS 4,718,376 1/1988 Leroueil et al. ..... 122/392 X 4,920,994 5/1990 Nachbar ..... 122/379 X

*Primary Examiner*—Edward G. Favors

*Attorney, Agent, or Firm*—William K. Wissing

[57] ABSTRACT

A method and apparatus for removing salt-cake deposits from boiler surfaces found in the upper areas of recovery furnaces. More specifically, in the Kraft papermaking process, a black liquor is produced which is combusted in a recovery furnace in order to supply heat for steam generation. Hot flue gases containing inorganic salt combustion by-products are passed through and around boiler heat exchange tubes found in the upper furnace areas. Deposits of the inorganic salt components are formed on the heat exchange tubes, thus insulating the tubes from the hot flue gases and resulting in lower heat recovery boiler efficiency. A laser is mounted proximate the furnace such that a high energy beam of coherent light generated by the laser is directed to the heat exchange tubes of the boiler found within the furnace, whereby the beam contacts the deposits which insulate the heat exchange tubes, thereby causing a change in the structure of the salt-cake leads to physical degradation of the deposit, thus allowing removal of the deposit layer.

19 Claims, 3 Drawing Sheets

METHOD AND APPARATUS FOR REMOVING DEPOSIT FROM RECOVERY BOILERS

FIELD OF THE INVENTION

This invention relates to method and apparatus for removal of deposits from boilers. More particularly, this invention is concerned with removal of salt-cake type deposits from boilers found in recovery furnaces, which furnaces are used in the paper industry and are fueled with black liquor.

BACKGROUND OF THE INVENTION

Recovery furnaces which utilize black liquor for fuel are well known in the art. In general, these recovery furnaces have a boiler section which converts heat of combustion of the black liquor into steam. The boiler section is generally made up of a series of drums and heat exchange tubes through which water and/or steam is circulated under pressure. The combustion reaction in the furnace creates heat which converts the water or steam in the boiler section into high pressure steam which is then used to drive a turbine generator to produce electricity.

In the papermaking industry, spent or "black" liquor, is produced as a by-product of the kraft papermaking process. The black liquor is used to fuel a recovery furnace in the paper industry, as it is a relative high fuel value by-product which otherwise would be wasted. The inorganic components of the black liquor are recovered for re-use in the Kraft wood pulping process.

The Kraft process utilizes "white" liquor which contains chemicals for digesting wood chips to obtain pulp. The active chemicals in the white liquor are sodium hydroxide (NaOH) and sodium sulfide ($Na_2S$). Wood chips are added to the white liquor so as to digest the lignin which holds the wood fibers together. The mixture after cooking is then separated, with the resulting pulp being sent to a paper processing facility and the residual black liquor to the recovery furnace for use as fuel and recovery of chemicals.

One of the problems which arises in the recovery furnaces which burn black liquor is the accumulation of deposits on the outer surface or "fireside" of the recovery boiler section. The evaporation and burning process of black liquor in the recovery furnace creates hydrolysis salts called "salt-cake", primarily composed of sodium sulfate ($Na_2SO_4$) and sodium carbonate ($Na_2CO_3$). These salt residues, generally consisting of about 70% $Na_2SO_4$ and 30% $Na_2CO_3$ are deposited on the heat exchange tubes, and thus foul the upper surfaces of the boiler section, thereby insulating the heat exchange tubes from the heated flue gases generated by the recovery furnace and, in extreme cases, obstructing the upper boiler section gas passages.

The salt-cake deposits which form on the upper surfaces of the boiler as a result of the evaporation and burning of black liquor present a significant problem in maintaining the boiler's thermal efficiency. In order to remove the salt-cake deposits, "blowers" have been developed to remove the deposit from the upper surfaces of boilers and recovery furnaces. See G.A. Smook, *Handbook for Paper and Pulp Technologists*, pp. 134–135. Soot blowers utilize high-pressure steam to mechanically remove the deposits from the tubes. It is necessary to regularly engage mechanical soot blowers in a recovery furnace to remove the deposits from the upper surfaces of the boiler section.

Often, the gas temperature in a recovery furnace is sufficiently high to cause the hydrolysis salts and ash particles in suspension to become sticky and tacky. When this occurs, the deposit fouls the superheater structure of the boiler section, the transport tubes and other upper boiler sections. When a deposit is sticky and tacky, which is typical in overloaded situations, it cannot be controlled with mechanical soot blowers. Additionally, when the deposits become thick enough, they can block the passage of combustion gases, thereby preventing the boiler section from functioning properly. The deposits then become hard and extremely difficult to remove with a mechanical soot blower.

The soot blowers furthermore use steam provided by the boiler section to remove the deposits. A significant portion of the steam which could otherwise be used to drive the turbines to produce electricity must be diverted for use in the soot blower to remove the deposits from the heat exchange tubes. This has a distinct disadvantage in that a substantial portion, sometimes up to 5% of the energy output of the recovery boiler, is used for the operation of the soot blowers.

Additionally, when soot blowers are ineffective to completely remove salt-cake deposits from the heat exchange tubes, the recovery furnace must be shut down until the cleaning operation is completed. Thus, valuable time is lost in this deposit removal method.

There is a recognized, long-felt need in the art for improved methods and apparatus to remove deposits , from the upper surfaces of a boiler since conventional mechanical soot blowers cannot efficiently accomplish this task.

Various methods and devices have been suggested to remove deposits from heat exchange tubes in boilers. An example of a class of these devices can be found in U.S. Pat. No. 4,018,267, Tomasicchio. Tomasicchio discloses methods and apparatus which shake or strike the deposit covered surfaces in a boiler in order to try and dislodge solid deposits on the tubular arrays therein. Similar to the devices disclosed in Tomasicchio are the devices disclosed in U.S. Pat. No. 4,497,282, Neundorfer. The devices disclosed in Neundorfer apply high frequency shock energy to tubes in a steam generator in order to "de-slag" the tubes.

The devices disclosed in Neundorfer and Tomasicchio have been found to be unsatisfactory since the devices disclosed in these references require application of high-energy shock waves which can damage and dislodge the heat exchange tubes in the boiler section and other equipment located within the recovery furnace. Furthermore, the device disclosed in Neundorfer and Tomasicchio require substantial additional apparatus within the recovery furnace itself in order to accomplish the task of cleaning the deposits from the tubes. This requires substantial capital investment in additional equipment and considerably more time and effort in maintenance.

Examples of standard mechanical soot blowers can be found in U.S. Pat. No. 4,421,067, Krowech. The devices disclosed in Krowech utilize a rotary soot blower tube coupled to a valve-controlled pneumatic actuator. This device is then fixed to the vessel which it is intended to de-slag. The valve-controlled pneumatic actuators disclosed in Krowech move a soot blower tube back and forth against the vessel as the soot blower ejects steam to clean the vessel walls. This motion is intended to loosen the deposits along the vessel walls so that the standard mechanical soot blowing action can more easily remove the deposits.

The devices disclosed in Krowech fail to satisfy the requirement for a device to remove heavy deposits from heat exchangers and upper boiler surfaces since they generally can only loosen the loosely adhered deposits. The mechanical actuators disclosed in Krowech are also potentially damaging to the heat exchange tubes and vessel walls.

It is also known in the soot blower art to utilize water jets to provide slag removal. However, the use of a water jet is generally impractical for deposit removal since it is difficult to control and limit the thermal shock of the water jet against the tubes to prevent premature failure of the tubes. See, e.g., U.S. Pat. No. 4,422,882, Nelson et al., at column 1, lines 14–25. The devices disclosed in Nelson et al. require delivering liquid from a high pressure source against soot deposits on boiler section tubes in a pulsed manner. Additionally, it is impractical to use water jets in a recovery furnace used in the paper industry due to the high risk of explosion if water contacts molten slag in the recovery furnaces. Thus, the devices disclosed in Nelson et al. run the high risk of rupturing the tubes as the high pressure liquid impinges on their surfaces. Furthermore, depending upon the tenacity of the soot deposits lodged to the tube, the devices disclosed in Nelson et al. will not efficiently remove all of the deposit. Thus, the devices disclosed in Nelson et al. do not satisfy the requirements for safe and efficient removal of deposits from the upper surfaces of a boiler.

Lasers have been used in the past to remove unwanted materials from surfaces. An example of such an application can be found in U.S. Pat. No. 4,368,084, Langen et al. The devices disclosed in Langen et al. comprise laser beams which are focused on metallic objects having a coating of rust. The lasers pulse coherent light energy on the rust which then evaporates.

Other uses of lasers to clean surfaces are disclosed in U.S. Pat. No. 3,503,804, Schneider et al. The devices disclosed in Schneider et al. teach the use of laser beams which agitate a liquid jet to produce sonic cleaning of the surface. These devices, like those disclosed in Nelson et al., involved the use of water, which is intolerable in recovery furnaces which contain molten slag, such as when burning black liquor.

Thus, the devices disclosed in Schneider et al. and Langen et al. do not satisfy the requirements for devices which can safely, efficiently, and consistently remove deposits from heat exchange tubes found in the high-temperature boiler.

It has been known to use lasers to remove slag deposits which are generated in the melting chamber of a lower furnace section. See German Patent 3243808. The German patent discloses use of a laser to ensure that the discharge opening of a melting chamber in a furnace remains open. Melting chambers are found in the lower parts of a furnace used in coal power plants and are used to remove slag buildup in the lower parts of the furnace. The devices taught in the German patent do not provide a satisfactory solution for a deposit removal device to efficiently and economically dispose of hardened deposits in the upper section of boilers.

There has thus been a long-felt need in the art for devices and methods which substantially remove deposits from surfaces found in the upper boiler section of a boiler found in recovery furnaces used in the papermaking industry.

SUMMARY OF THE INVENTION

A method and apparatus is provided in accordance with this invention to satisfy the aforementioned long-felt needs in the art for safe and efficient removal of deposits formed on the upper surfaces of a boiler section in a recovery furnace which is fueled with black liquor. In accordance with the preferred embodiments of this invention, inorganic salt deposits formed on the upper boiler section are removed with a plurality of lasers operatively mounted proximate the recovery furnace. The lasers have a field of view encompassing the boiler section, whereby energy from the lasers can be directed to the deposits on the heat exchange tubes to loosen and remove the deposits.

DETAILED DESCRIPTION OF PREFERRED EMBODIMENTS

Figure 1:
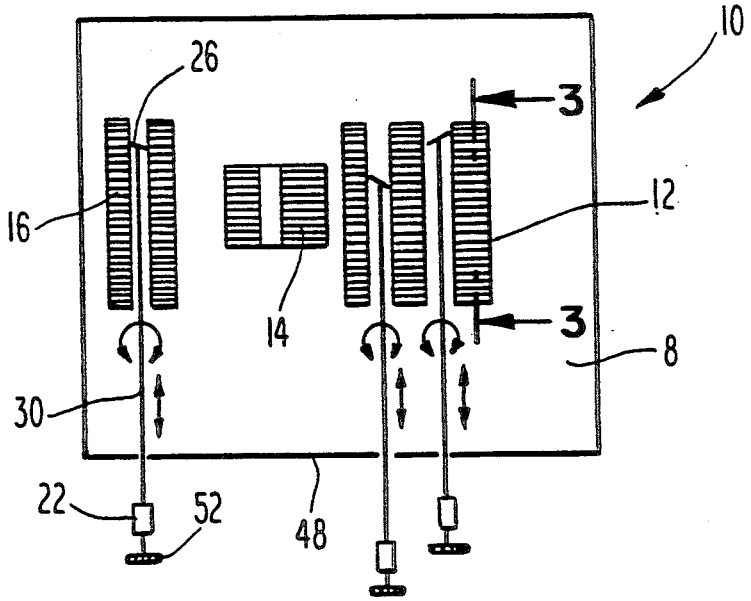
FIG. 1 is a top-view, cross-section schematic illustrating in one embodiment the location of the deposit removal apparatus in relationship to the boiler and heat exchange section.

This invention is directed to method and apparatus for removing deposits from a heat exchange section of a boiler. The heat exchange section is comprised of heat exchange tubes that collect heat from the flue gases to provide steam for the electric turbines to produce electrical energy.

Typically, the overall dimensions of a complete recovery furnace used in the paper industry are on the order of one hundred feet high by seventy feet long. The boiler section of a recovery furnace is typically on the order of seventy-two feet high by sixteen feet across. Thus, it should be recognized that the drawings presented herein are merely illustrative schematics and are not intended to be considered as accurate, scaled representations of the components of a boiler.

The recovery furnace comprises a heat exchange chamber for receiving high temperature flue gases and a boiler section which includes a heat exchange section. The heat exchange section of the boiler is disposed in the upper section of the recovery furnace. The heat exchange section is made up of heat exchange tubes which carry an appropriate liquid, for example, water, to produce steam for the electrical generation means.

In the combustion process which produces the heat, flue gases are created which are fed to the heat exchange chamber. The gases circulate throughout the upper portions of the boiler, at which point the flue gases contact the heat exchange tubes. In the case of boilers used in the papermaking industry, wherein black liquor is used to power the recovery furnace, the combustion by-products deposited on the upper surfaces of the boiler section are comprised of about 70% $Na_2SO_4$ and 30% $Na_2CO_3$.

The $Na_2CO_3$ and $Na_2SO_4$ combustion by-products form heavy deposits on the furnace walls and heat exchange tubes which harden and insulate the heat exchange tubes, thereby preventing efficient heat exchange. Deposits formed on the upper surfaces of a boiler section found in a recovery furnace used in the papermaking industry cause significant additional expense in running the furnaces. The methods and apparatus provided in accordance with this invention provide safe, effective removal of these deposits from the heat exchange tubes found in upper areas of any type of boiler.

It has been discovered that a laser of a selective transmission wavelength can be used effectively to remove deposits from the heat exchange tubes found in the upper areas of a recovery furnace. In the case of a black liquor boiler, the deposit has an infrared absorption band in the 9–11 micrometer range. A carbon dioxide ($CO_2$) laser which emits a high energy beam of coherent light having wavelength in the 9–11 micrometer range is efficient for removing the deposits from the heat exchange tubes. The laser energy which is absorbed by the deposit causes a structural change in the deposit such that the deposit is effectively loosened so that it can be removed from the heat exchange tubes. The structural change in the deposit may be characterized as physical degradation, such as melting, fracturing or stressing of the deposit layer, or a combination thereof.

It is generally desirable to operatively mount at least one laser proximate the recovery furnace such that the beam of coherent light can be directed to irradiate the heat exchange section. Preferably, a plurality of lasers are mounted externally to the recovery furnace so as to prevent damage to the lasers by the high temperatures and inorganic-salt- containing flue gases found within the recovery furnace. One method of accomplishing this is to direct the laser beams using a reflective means such as a mirror. Other optical methods of focusing laser energy, such as lens means, may also be used to direct the laser beam. Additionally, electrical and/or mechanical means for providing longitudinal and radial displacement of a reflective means, in cooperation with the laser, may be used to direct the bean, thereby allowing the beam to contact the deposits which insulate the heat exchange means. Other combinations of the various directing means may also be used to direct the laser energy.

It is estimated that by using lasers provided in accordance with this invention to loosen and remove deposits on heat exchange tubes, a three-fold savings in deposit removal costs may be achieved. The capital and maintenance costs of installing and operating a standard soot blower in a recovery furnace of the type used in the paper making industry are extremely high. The capital and maintenance costs for installing and operating a laser system provided in accordance with this invention would be significantly lower than the cost of installing a mechanical soot blower. These advantageous cost savings significantly increase the recovery boiler's efficiency and substantially reduce the overall operating costs for running a recovery furnace.

Figure 2:
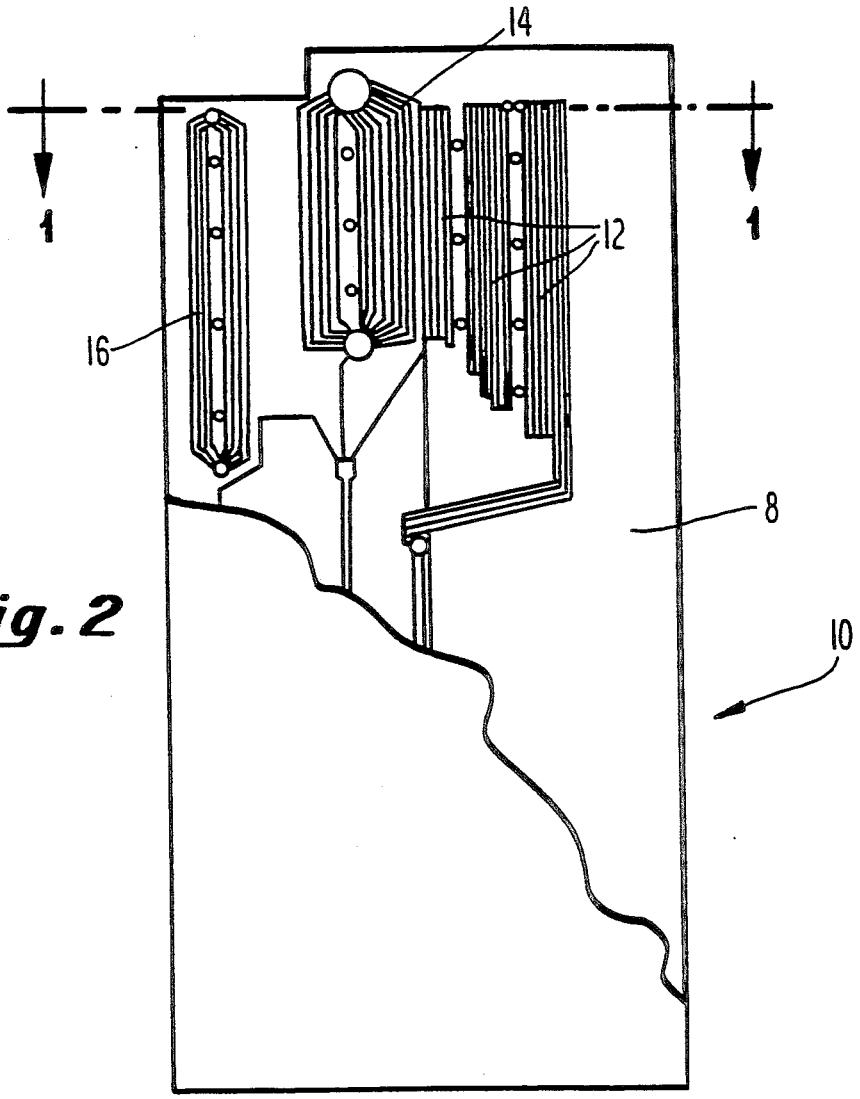
FIG. 2 is a partial cut-away, front view schematic illustrating a boiler having a heat exchange section situated in the upper areas of a recovery furnace.

Referring to the drawings wherein like reference numerals refer to like elements, FIG. 2 is a schematic of a boiler section typically found in a recovery furnace 10.

The heat exchange chamber is shown at 8. A bank of heat exchange tubes 12, known as the superheater, is disposed in the upper area of the heat exchange chamber 8 in order to transfer heat out of the chamber. Additionally, banks of heat exchange tubes 14 (boiler bank) and 16 (economizer) are also disposed in the upper chamber area. Collectively, banks 12, 14 and 16 make up a tubular heat recovery system which comprises the heat exchange section of the boiler, which heat exchange section is found in the upper area of the recovery furnace.

The combustion process carried out in the combustor portion of the furnace 10 creates hot gases which are laden with inorganic salts. The gases containing inorganic salts circulate throughout the boiler section such that steam/water in the heat exchange section is heated. The heat exchange section carries heated steam to a turbine to generate electrical energy. Because the heat exchange section is at a lower temperature than the gases produced in the chamber 8, heat is transferred to the circulated heated steam. During this transfer process the inorganic slat laden gas condenses on the superheater 12, thus depositing the inorganic salts, for example, $Na_2SO_4$ and $Na_2CO_3$, on the superheater. The same condensation/deposition mechanism applies to the other banks of heat exchange tubes 14 and 16, but to a lesser degree. The majority of the deposits are formed on superheater 12, that being the area which first comes in contact with the hot flue gases.

Figure 3:
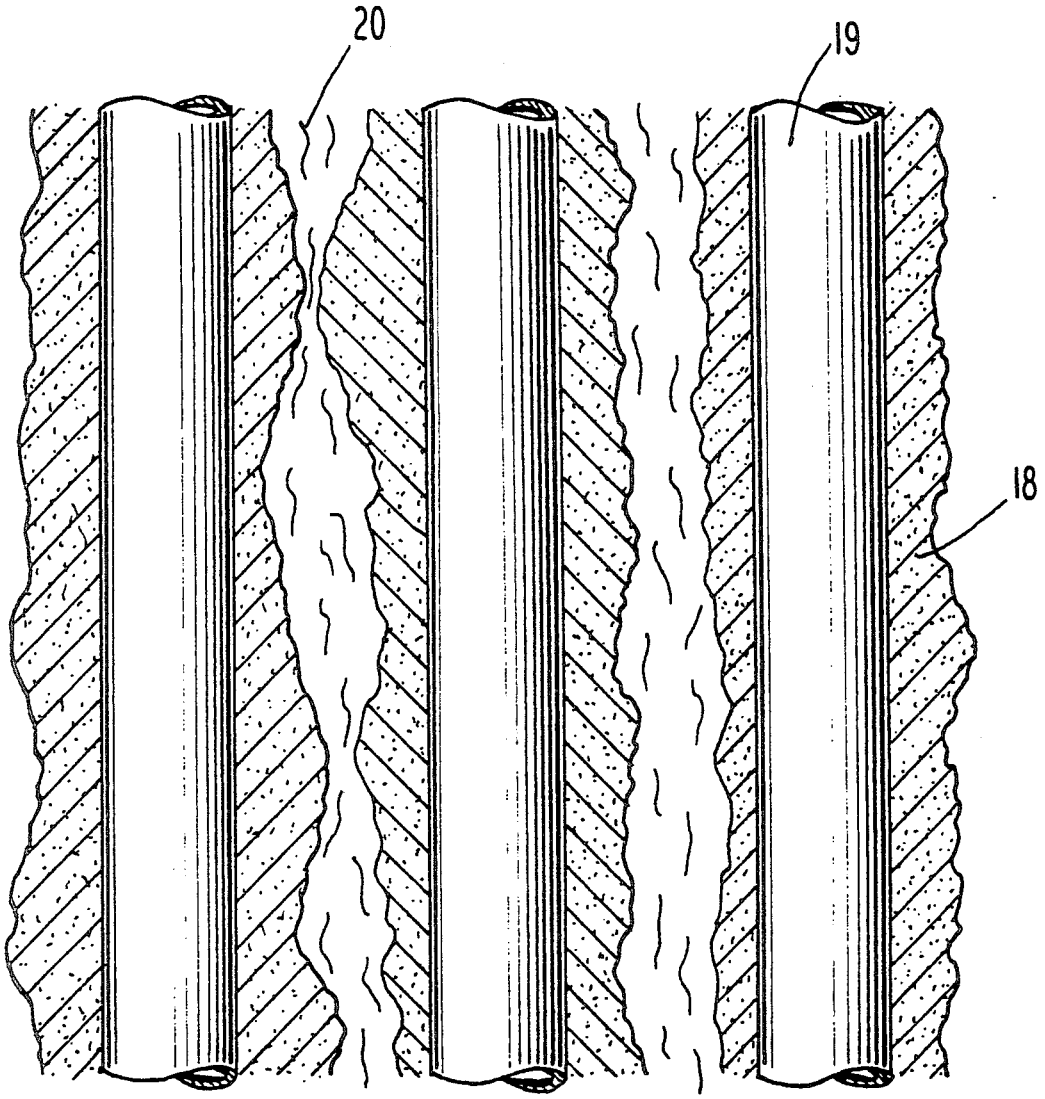
FIG. 3 is a pictorial cross-section representation of the heat exchange tubes upon which salt-cake is deposited.

This deposit 18 (FIG. 3) rapidly covers the heat exchange tubes 19 and forms a thick and hard layer on the tubes. As the boiler is operated, the deposit layer 18 severely impedes efficient and proper operation of the heat exchange section by insulating the heat exchange tubes 19 and impeding the flow of flue gases 20. Where a boiler used in the papermaking industry is utilized, a $CO_2$ laser may be used to remove the deposit 18.

Referring to FIG. 1, wherein a preferred embodiment is shown, a plurality of lasers 22 are operatively mounted externally to the recovery furnace 10 such that coherent laser light can be directed to irradiate portions of the heat exchange section (collectively banks of heat exchange tubes 12, 14, and 16) which may be covered by deposits 20.

The laser 22 is removably attached to a first end of a rotatable rod 30, while a reflective means 26 for directing the high energy beam is fixedly attached to a second end of the rotatable rod 30. The rotatable rod 30 is attached at its first end to means for radial displacement 52 about the axis of the rotatable rod 30. The rotatable rod 30 is also attached to means for longitudinal displacement (FIG. 4) substantially perpendicular to the wall of the recovery furnace 10. The rotatable rod 30 is disposed through an opening in the recovery furnace wall.

The laser means 22 emits a high energy beam of coherent light which travels in a path substantially parallel to the rotatable rod 30 and strikes the reflective directing means 26. The reflective directing means can be rotated radially about the axis of the rotatable rod 30, thereby directing the high energy beam along the surfaces of the heat exchange section (collectively 12, 14, 16) containing the deposits.

While only three laser means are shown in FIG. 2, one skilled in the art will recognize that at least one laser means is required and that the location and number of laser means utilized in the invention will be determined by the size and configuration of the heat exchange section located within the recovery furnace.

Figure 4:
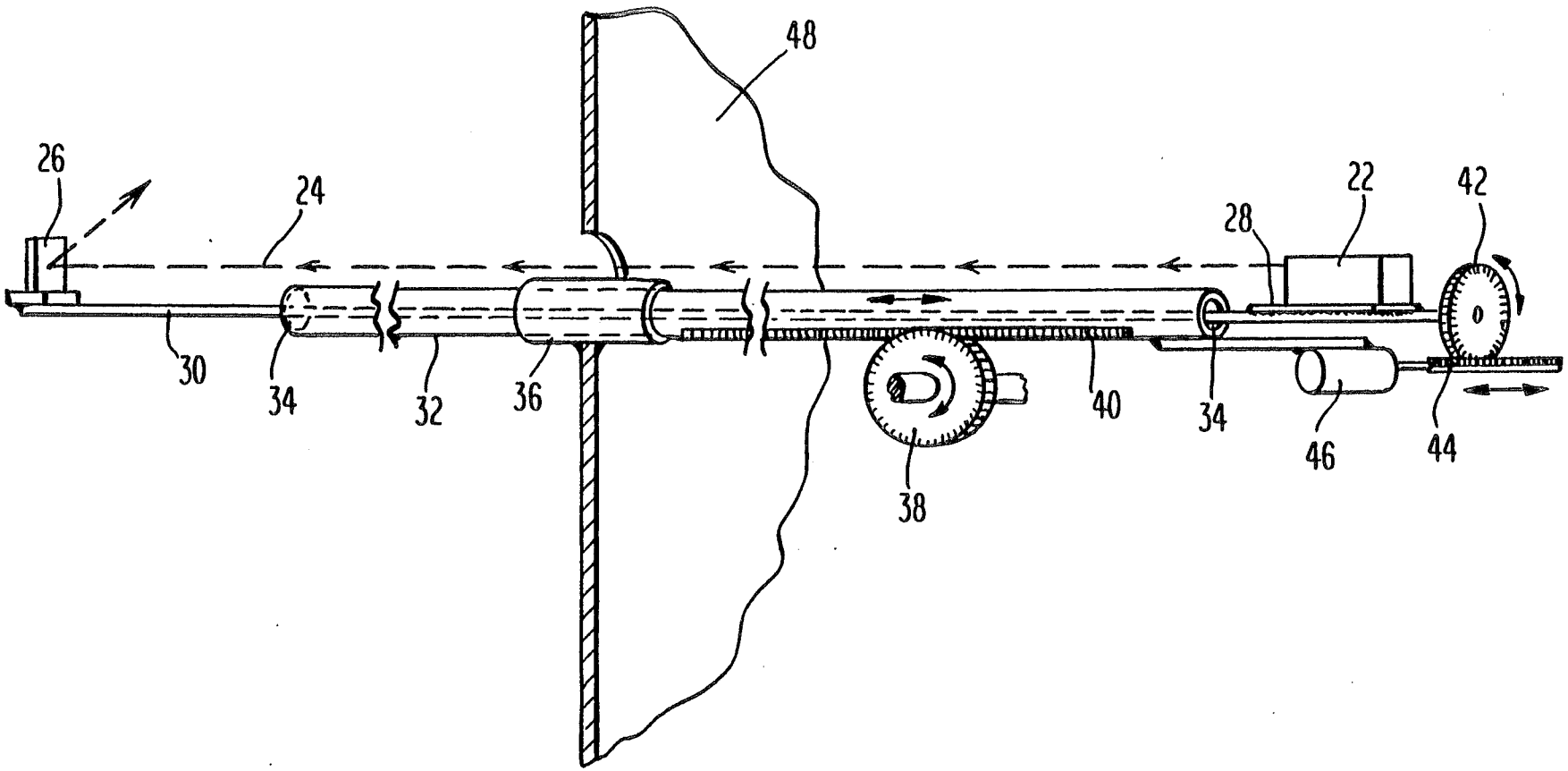
FIG. 4 is a schematic illustration of an apparatus for removal of deposits in accordance with the present invention.

FIG. 4 is an expanded illustration of the deposit removal means shown in FIG. 2. A bushing 36 having an opening extending therethrough is fixedly attached to the furnace wall 48 for attaching the laser means and directing means proximate the recovery furnace. A longitudinally displaceable tube 32 having an orifice therethrough and bearing means 34 located at both the first and second end of the tube is disposed through the bushing 36. A rotatable rod 30 is then disposed through the bearings 34, extending beyond the first and second end of tube 32. A rack 40 and pinion 38 are interfaced with tube 32 such that the tube 32 can be displaced longitudinally along an axis substantially perpendicular to the recovery furnace wall 48.

Laser means 22 is removably attached to a platform 28, which in turn is fixedly attached to the first end of the rotatable rod 30. Pinion 42, fixedly attached to the first end of rod 30, is interfaced with rack 44. Rack 44 is rotatably attached to the rack actuating means 46, which is fixedly attached to tube 32. The rack 44 and pinion 42 assembly which comprise the means for radial displacement 52 (FIG. 1), allows for radial rotation of rod 30 about an axis substantially perpendicular to the recovery furnace wall 48.

Reflective means 26 for directing a high energy beam and is located within the heat exchange chamber. 30 and is located within the heat exchange chamber. Means for generating power to the laser means (not shown) charges the laser means 22, whereby a high energy beam of coherent light 24 is emitted from laser 22 along an axis which is substantially parallel to the rotatable rod 30. Beam 24 strikes the reflective means 26 for directing the high energy beam and is directed such that the beam may contact the deposits which insulate the heat exchange tubes.

The rotatable rod interfaced with the laser 22 via the rack 42 and pinion 44 assembly, including the rack actuating means 46, and the longitudinally displaceable tube 32, including rack 40 and pinion 38, interfaced with the laser 22 via the rotatable rod 30, are additional means for directing the light beam 24 used in conjunction with reflective means 26.

While the apparatus described above is the preferred embodiment, one skilled in the art will recognize that other embodiments of means for attaching the laser means to the recovery furnace and means for directing the beam to the deposits, whether they be mechanical means, electrical means, optical means, or otherwise, or combinations thereof, are anticipated as falling within the scope of this invention.

The laser's transmission bandwidth substantially corresponds to the deposit's absorption band. The deposit is contacted by the beam of coherent light generated by the laser. If, for example, the deposit consists of $Na_2SO_4$ and $Na_2CO_3$, which forms on the upper surfaces of a boiler used in the papermaking industry, it is preferred that the laser be a $CO_2$ laser with a transmission bandwidth from about 9 to about 11 micrometers.

The laser may be a continuous laser or a pulsed laser. When a continuous laser is used, it is desired to provide a means to cool the laser during operation. The continuous carbon dioxide laser has an output of from about 50 to 150 watts, while the pulsed carbon dioxide laser has an output of about one joule per second. It is desirable to provide a means for viewing substantially the entire boiler section inside of the recovery furnace wherein the heat exchange section is situated. In preferred embodiments, viewing means may be, for example, a video camera.

Since the $Na_2SO_4$ and $Na_2CO_3$ deposit has an infrared absorption band in about the 9–11 micrometer range, strong absorption of the laser energy by the deposit occurs such that the laser energy causes a structural change in the deposit. Thus, the $CO_2$ laser effectively removes substantially all deposits formed on the upper surfaces of a boiler used in the papermaking industry.

However, if the deposit is sufficiently thick and heavy, application of the laser energy to the deposit may not totally remove the deposit from the heat exchange section. When this occurs, the coherent radiation from the laser effectively loosens the deposit from the heat exchange section. Standard mechanical soot blowing techniques are then able to remove the weakened deposits from the upper surfaces of the boiler and the heat exchange section with much less energy, thus allowing a more efficient generation of electricity and lowering the risks of damaging the heat exchange section.

Methods and apparatus provided in accordance with this invention solve a long-felt need in the art for removing heavy deposits from the upper surfaces of a boiler. Boilers used in the papermaking industry generally experience heavy deposits on the upper surfaces of the boiler which reduce boiler efficiency. The lasers provided in accordance with this invention will effectively remove these deposits from the upper surfaces of the boiler.

There have thus been described certain preferred embodiments of methods and apparatus provided in accordance with this invention. While preferred embodiments have been described, it will be recognized by those with skill in the art that modifications are within the scope of the invention. The appended claims are intended to cover all such modifications.

What is claimed is:

1. In a recovery furnace of the type used in the papermaking industry, wherein "black" liquor is burned to generate heated flue gases which contain a component of inorganic salts, said furnace comprising a heat exchange chamber and a boiler section, which includes a heat exchange section disposed in the upper section of the recovery furnace, wherein the flue gases circulate about the boiler section, thereby forming a salt-cake deposit on the heat exchange section, said deposit having a specific absorption band and insulating the heat exchange section from the heated flue gases, thereby decreasing the operating efficiency of the boiler section; an apparatus for removing the deposit from the heat exchange section of the boiler, comprising:

a. means for producing a high energy beam of coherent light having a transmission wavelength which substantially corresponds to the specific absorption band of the salt-cake deposit; and b. means for directing the high energy beam, of coherent light, in cooperation with the means for producing a high energy beam of coherent light and the furnace, such that the beam is directed to the heat exchange section to contact the deposits which insulate the heat exchange section and cause a structural change in the salt-cake deposit, such that the deposit is effectively loosened and removed from the heat exchange section.

2. The apparatus in accordance with claim 1 wherein the means for producing a high energy beam of coherent light is a carbon dioxide gas laser.

3. The apparatus in accordance with claim 2 wherein the laser is a continuous carbon dioxide gas laser.

4. The apparatus in accordance with claim 3 further comprising means for cooling the laser.

5. The apparatus in accordance with claim 3 wherein the laser has an output of about 50 to about 150 watts.

6. The apparatus in accordance with claim 2 wherein the laser is a pulsed carbon dioxide gas laser.

7. The apparatus in accordance with claim 6 wherein the laser has an output of about one joule per second.

8. The apparatus in accordance with claim 1 wherein the transmission wavelength is from about 9 to about 11 micrometers.

9. The apparatus in accordance with claim 1 wherein the means for directing the high energy beam of coherent light is selected from the group consisting of reflective means, optical means, electrical means, and mechanical means, or combinations thereof.

10. The apparatus in accordance with claim 1 wherein the means for directing the high energy beam of coherent light is a mirror.

11. The apparatus in accordance with claim 1 wherein the means for directing the high energy beam of coherent light is a lens.

12. The apparatus in accordance with claim 2 wherein the means for directing the high energy beam of coherent light is a mechanical and/or electrical means for providing longitudinal and radial displacement of a reflective means, in cooperation with the laser.

13. The apparatus in accordance with claim 1 wherein the structural change in the salt-cake deposit is characterized as a physical degradation selected from the group consisting of melting, fracturing, and stressing of the deposit, or combinations thereof.

14. In a recovery furnace of the type used in the papermaking industry, wherein "black" liquor is burned to generate heated flue gases which contain a component of inorganic salts, said furnace comprising a heat exchange chamber and a boiler section, which includes a heat exchange section disposed in the upper section of the recovery furnace, wherein the flue gases circulate about the boiler section, thereby forming a salt-cake deposit on the heat exchange section, said deposit having a specific absorption band and insulating the heat exchange section from the heated flue gases, thereby decreasing the operating efficiency of the boiler section; a method for removing the deposits from the heat exchange section of the boiler comprising:

a. providing means for producing a high energy beam of coherent light having a transmission wavelength which substantially corresponds to the specific absorption band of the salt-cake deposit;

b. supplying power to the means for producing a high energy beam of coherent light to cause the light producing means to emit the high energy beam of coherent light; and c. directing the high energy beam of coherent light such that the beam is directed to the heat exchange section of the boiler to contact the deposits which insulate the heat exchange section and cause a structural change in the salt-cake deposit, such that the deposit is effectively loosened and removed from the heat exchange section.

15. The method in accordance with claim 14 wherein the transmission bandwidth is from about 9 to about 11 micrometers.

16. The method in accordance with claim 15 wherein the means for producing a high energy beam of coherent light is a continuous carbon dioxide gas laser having an output from about 50 to about 150 watts and further comprising means for cooling the continuous carbon dioxide gas laser.

17. The method in accordance with claim 15 wherein the means for producing a high energy beam of coherent light is a pulsed carbon dioxide gas laser having an output of about one joule per second.

18. The method in accordance with claim 14 wherein the structural change in the salt-cake deposit is characterized as a physical degradation selected from the group consisting of melting, fracturing, and stressing of the deposit layer, or a combination thereof.

19. The method in accordance with claim 14 further comprising the step of using a mechanical soot removal means in cooperation with the furnace to remove the deposits from the heat exchange section after the high energy beam of coherent light has contacted and loosened the deposits found on the heat exchange section.

* * * * *